US007229062B1

(12) United States Patent
Rascon

(10) Patent No.: US 7,229,062 B1
(45) Date of Patent: Jun. 12, 2007

(54) RETENTION APPARATUS AND METHOD FOR STABILIZING CONCRETE FORMS

(76) Inventor: Robert Rascon, 72 Alexander Ave., San Jose, CA (US) 95116

( * ) Notice: Subject to any disclaimer, the term of this patent is extended or adjusted under 35 U.S.C. 154(b) by 0 days.

(21) Appl. No.: 10/668,712

(22) Filed: Sep. 23, 2003

(51) Int. Cl.
*E04G 17/06* (2006.01)
*E04G 9/02* (2006.01)

(52) U.S. Cl. ..... 249/5; 249/218

(58) Field of Classification Search ..... 249/2, 249/3, 4, 5, 6, 7, 34, 213, 216, 218
See application file for complete search history.

(56) References Cited

U.S. PATENT DOCUMENTS 1,016,285 A * 2/1912 Meek ..... 249/192
1,082,470 A * 12/1913 Phelan ..... 249/219.1
1,202,269 A * 10/1916 Cramer ..... 249/4
1,279,059 A * 9/1918 Whiteway et al. ..... 249/5
1,397,253 A * 11/1921 Jones ..... 249/5
1,451,457 A * 4/1923 Buchenau ..... 249/218
1,683,446 A * 9/1928 Brown ..... 249/218
2,180,842 A * 11/1939 Winding ..... 249/5
2,298,837 A * 10/1942 Oswald ..... 249/5
2,442,962 A * 6/1948 Rumble ..... 249/34
2,635,320 A * 4/1953 Ornitz ..... 249/5
2,894,307 A * 7/1959 Hogan et al. ..... 249/208
3,207,465 A * 9/1965 Papin ..... 249/5
3,288,426 A * 11/1966 Simpson ..... 249/5
4,029,288 A * 6/1977 Murphy et al. ..... 249/216
4,066,237 A * 1/1978 Bentz ..... 249/4
4,202,145 A * 5/1980 Coulter et al. ..... 249/3
4,257,571 A * 3/1981 Franks ..... 249/34
4,291,858 A * 9/1981 NeSmith ..... 249/216
5,156,753 A * 10/1992 Speidel ..... 249/5
5,343,667 A * 9/1994 Peden ..... 249/5
5,817,247 A * 10/1998 Colatruglio ..... 249/4
6,536,737 B1 * 3/2003 Davis ..... 249/3
2003/0101670 A1 * 6/2003 Gustin ..... 249/34

FOREIGN PATENT DOCUMENTS

FR 2575208 * 6/1986

* cited by examiner

*Primary Examiner*—M. Safavi
(74) *Attorney, Agent, or Firm*—John J. Leavitt

(57) ABSTRACT

Presented is an apparatus for stabilizing the form boards or members that define a cavity to receive wet concrete. The apparatus includes metal stakes having two sets of through-bores. The through-bores of one set are perpendicular to the through-bores of the other set and are spaced intermediately thereof. The stakes are driven into the ground in parallel pairs on opposite sides of the form boards. Nails are driven through one set of through-bores to attach the form boards to the stakes. A retention nail is slidably supported in a bore of the other set of bores so that it lies parallel to the form boards and above the top edges of the form boards. An elongated retention plate extends transversely above the form boards and opposite ends are detachably engaged to the nails that lie parallel to the form boards so as to prevent the form boards from displacing the stakes outwardly by the force exerted by the wet concrete. After the concrete sets or hardens, the retention plate is easily removed to enable removal of the stakes for reuse and dismantling of the form boards.

15 Claims, 3 Drawing Sheets

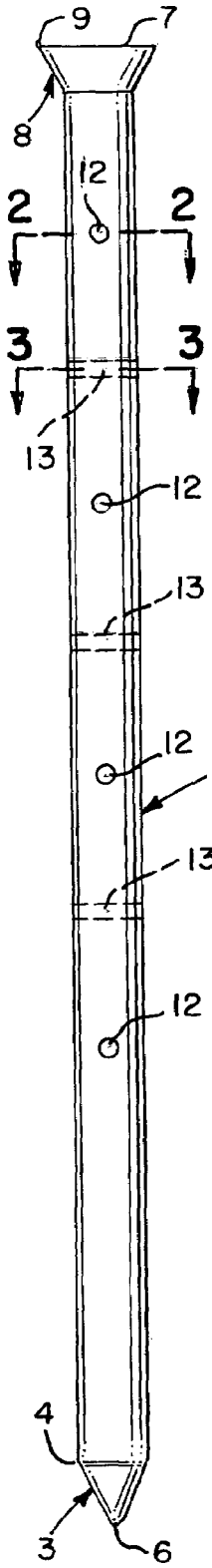
FIG.1
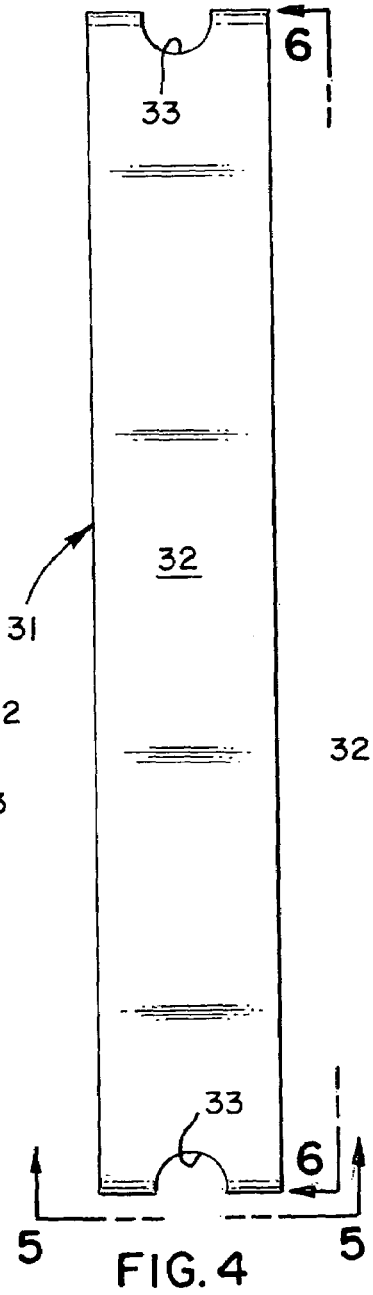
FIG. 4
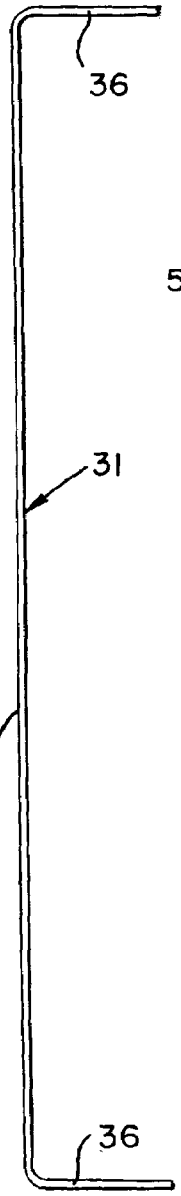
FIG. 6
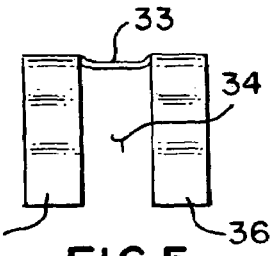
FIG.5
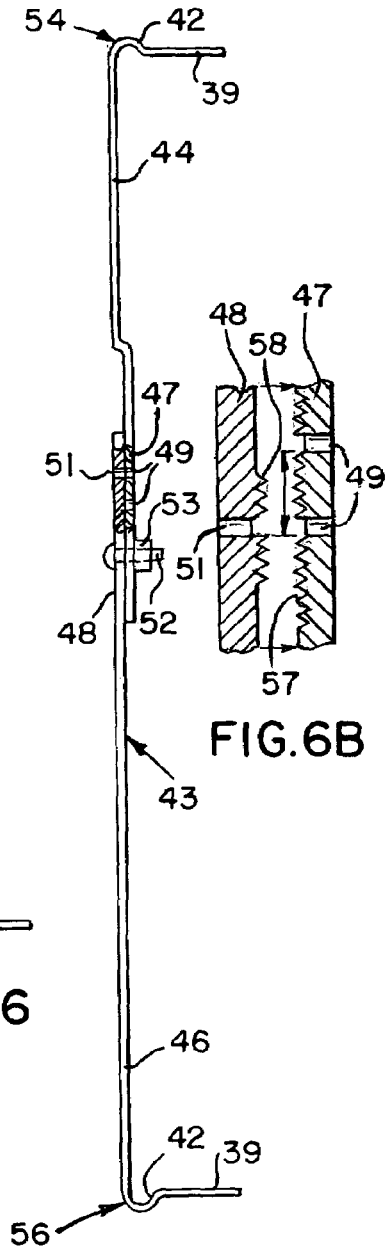
FIG.6B
FIG. 6A
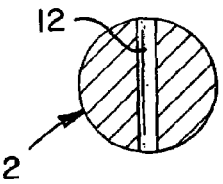
FIG. 2
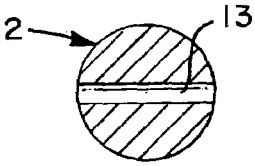
FIG. 3

RETENTION APPARATUS AND METHOD FOR STABILIZING CONCRETE FORMS

BACKGROUND OF THE INVENTION

This invention relates to concrete forms, and particularly to apparatus for retaining the concrete forms in their appropriate and selected spacing during the interval that wet concrete is being poured between the spaced forms and until the wet concrete sets or hardens. More specifically, the invention relates to a special type of stake to be driven into the ground in association with the form boards and providing means including a transversely extending retention plate detachably secured to the stakes to retain the concrete forms against spreading as a result of the pouring of concrete between the form boards.

DESCRIPTION OF THE PRIOR ART

A preliminary patentability and novelty search has revealed the existence of the following U.S. patents:

| | | |
|---|---|---|
| 920,787 | 1,082,470 | 1,279,059 |
| 1,472,018 | 1,635,093 | 1,814,521 |
| 1,897,530 | 1,922,584 | 2,298,837 |
| 2,313,880 | 2,356,309 | 2,635,320 |
| 2,661,516 | 2,663,925 | 2,731,700 |
| 2,745,165 | 2,793,416 | 2,795,836 |
| 2,894,307 | 3,057,269 | 3,256,655 |
| 3,256,659 | 3,288,426 | 3,596,420 |
| 3,788,020 | 4,012,159 | 4,202,145 |
| 4,229,920 | 4,579,312 | 4,595,168 |
| 4,712,764 | 4,776,555 | 4,824,068 |
| 5,154,837 | | 5,464,680 |

Reviewing the patents listed above, it will be apparent that the problem of maintaining the stability of the spaced apart form boards between which wet concrete is poured for both slabs and stem foundations has been a problem that has plagued the building industry for many years. The patents indicated above, particularly U.S. Pat. No. 920,787 issued May 4, 1909 indicates that the problem has been in existence for almost a full century, and the probability exists that the problem existed even before May 4, 1909.

Concrete foundations for buildings, particularly the so-called stem foundation upon which a mud-sill is provided as a base for floor joists, are usually formed by pouring wet concrete between latterly spaced form boards or form members that must be space a specific distance apart to provide the space between which the concrete is poured. In some instances, an attempt is made to stabilize the lateral spacing of the form boards providing a trench within which the lower edges of the form boards are placed against the sidewalls of the trench. In this type of construction, it is common practice in the building industry, particularly in one-story and two-story homes, to stabilize the upper exposed edges of the spaced form boards by nailing a wooden cleat across the upper edges of the form boards. One difficulty with this method of construction is that the wooden cleats are frequently split by the nails that are driven into them, or are split subsequent to the placement of the nails under the pressure of concrete tending to push the form boards apart. Accordingly, it is one of the objects of the present invention to provide a form board stabilizing apparatus that prevents the upper exposed edges of the form boards and the lower edges thereof from spreading apart when concrete is poured between them whether or not the lower edges of the form boards are deposited in a trench.

Another problem that must be addressed in the placement of form boards, is exactitude of the spacing between the boards and the facility with which the form boards may be removed from the concrete foundation after the concrete has set sufficiently to maintain its own stability. Accordingly, it is another object of the present invention to provide a form board stabilizing apparatus that provides exactitude in the spacing of the form boards, and may easily be removed once the concrete has set sufficiently to maintain its own stability.

It frequently happens that in the formation or construction of forms for the pouring of concrete, the form boards are not always parallel or at the same level. Thus, in some foundations, the concrete must be thicker at some places than it is at others, thus necessitating an adjustment of the apparatus that retains the form boards at their proper spacing. Accordingly, another object of the present invention is the provision of a form board stabilizing apparatus that includes a transverse retention plate that is adjustable in length to accommodate variations in the spacing of the form boards.

It will be seen from the disclosures of the patents listed above, that in some instances, the retention members that are intended to prevent the form boards from spreading apart at their upper edges upon the pouring of wet concrete between the form boards may be easily displaced so as to fail in their function of retaining the upper edges at the proper spacing. This problem generally occurs because there is insufficient means between the transversely extending plate and the vertical stakes that retain the form boards spaced apart and to which the transverse plate is attached. Accordingly, a still further object of the invention is the provision of a transverse retention plate that is configured to detachably engage a retention member that is itself detachably secured in the stake that is driven into the ground along the outside surfaces of the form boards.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the form board stabilizing apparatus of the invention comprises a specially designed stake that is driven into the ground to provide a lateral limit of spacing of the form boards and a transversely extending plate or bar that engages detachably with the stakes so as to retain the upper edges of the form boards at the proper spacing. Additionally, to maintain the vertical relationship of the stakes, means are provided to detachably fasten the stakes to the associated form boards by means that may easily be removed so as to detach the stakes from the associated form boards. More specifically, the stakes that are driven into the ground are provided along their length with spaced bores that extend at right angles to each other so that in one direction, nails may be inserted through the bores in the stake and driven into the associated form boards, and in the other bores that extend 90° to the bores that retain nails to be driven into the form boards, elongated pins or nails may be extended through such transverse bores which normally lie parallel to the form boards, and extend on opposite sides of the stake to provide a means to which a retention plate may be detachably secured. With two stakes spaced apart to retain the form boards at the proper spacing, a retention bar is extended perpendicularly to the form boards with the ends thereof cooperating with the stakes and the longitudinally extending pins or nails so as to detachably inter-engage the opposite ends of the transverse bar with the associated opposed stakes and thus provide a means for retaining the upper edges of the form boards at their proper selected spacing.

BRIEF DESCRIPTION OF THE DRAWINGS

FIG. 1 is a side elevational view of one of the stakes of the apparatus of my invention.

FIG. 2 is a horizontal cross-sectional view taken in the plane indicated by the line 2—2 in FIG. 1.

FIG. 3 is a horizontal cross-sectional view taken in the plane indicated by the line 3—3 in FIG. 1.

FIG. 4 is a top plan view of one embodiment of the retention bar that extends transversely across the top edges of the form boards and adapted to be detachably secured to the opposing stakes.

FIG. 5 is an end elevational view taken in the direction indicated by the arrows 5—5 in FIG. 4.

FIG. 6 is a side elevational edge view of the retention plate taken in the direction of the arrows on the line 6—6 in FIG. 4.

FIG. 6(A) is a side elevational edge view of a second embodiment of the retention bar illustrated in FIGS. 4, 5 and 6.

FIG. 6B is a fragmentary enlarged cross-sectional view of the mid-portion of the retention bar illustrated in FIG. 6A and illustrating the transverse lands and grooves that inter-engage when the end portions of the structure are overlapped and bolted as in FIG. 6A.

DETAILED DESCRIPTION OF THE PREFERRED EMBODIMENTS

Figure 7:
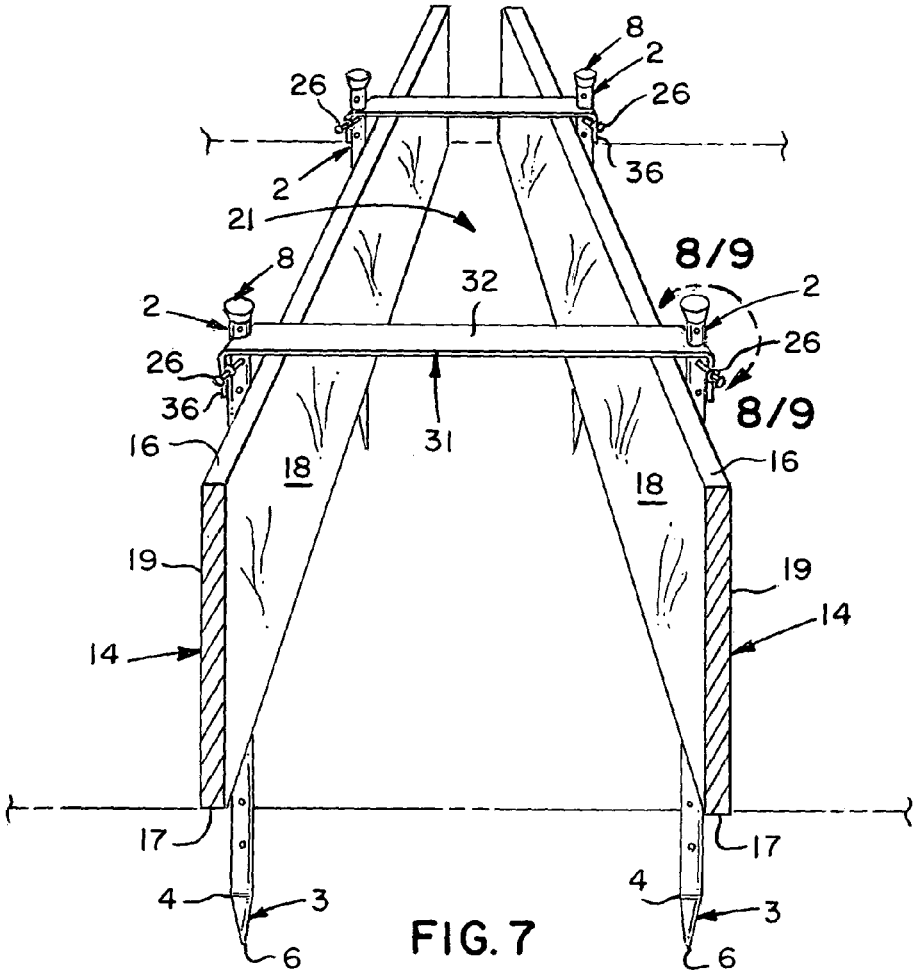
FIG. 7 is a perspective view illustrating the application of the form board retention apparatus assembled in position of use in association with a set of latterly spaced form boards.

In terms of greater detail, the concrete form retention and stabilization apparatus of the invention comprises a plurality of elongated stakes each designated generally by the numeral 2 and each having a determinant length required by the depth of the stem foundation to be poured and the height of the form members that define the space within which wet concrete is to be poured. Thus, the stakes 2 may be two feet long, or three feet long or four feet long, or any length therebetween, depending on the depth to which they must be driven into the ground to achieve vertical stability of the stakes and the form member(s) against laterally imposed forces by the wet concrete and the height of the form members above ground. Each of the stakes is preferably formed from metal, such as soft rolled steel, and is provided at one end with a conical point portion designated generally by the numeral 3 that includes a diametric dimension at 4 that merges with the diametric dimension of the stake body and a point 6 spaced therefrom that constitutes the bottom end of the elongated stake. At its top end 7, opposite the point 6, the stake is provided with a tapered head 8 the small diameter of which merges with the stake body and the large diameter of which defined by the periphery 9 is larger than the diameter of the stake to facilitate driving of the stake into the ground with an appropriate tool (not shown) such as a sledge hammer.

Intermediate the bottom point 6 and the top end 7, the stake is provided with a first set of a multiplicity of diametrically transverse bores 12 generally equally spaced along the length of the stake at intervals of approximately two inches. A second set of diametrically transverse bores 13 are generally equally spaced along the stake at two inch intervals between the set of transverse bores 12 but these bores 13 extend diametrically through the body of the stake perpendicularly to the bores 12 for a reason which will hereinafter be explained.

Figure 10:
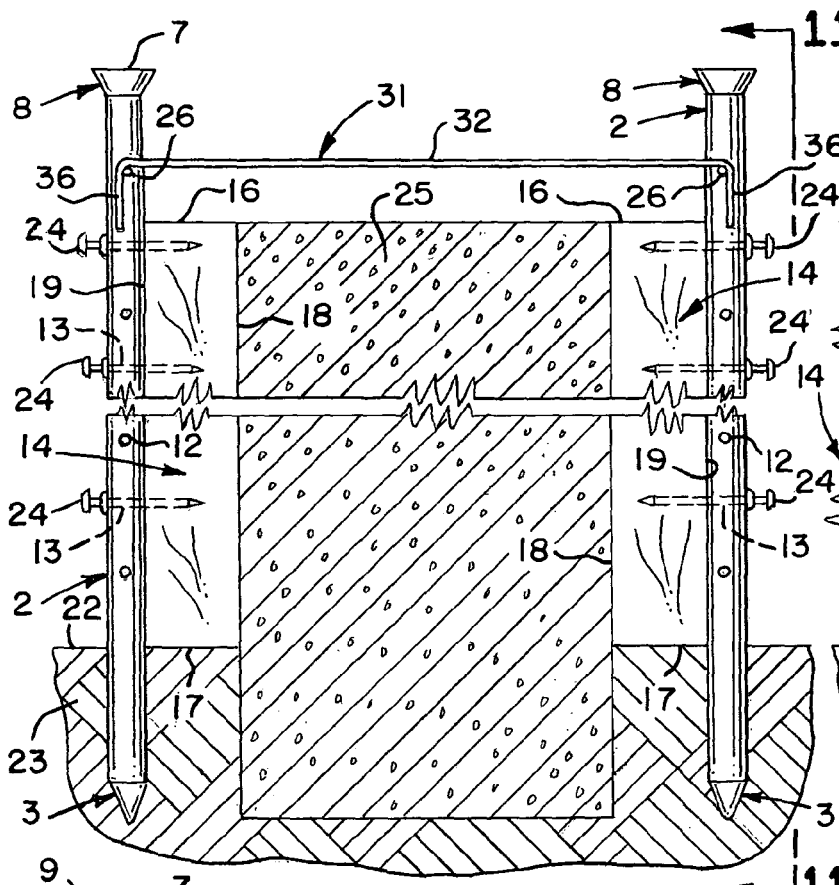
FIG. 10 is a vertical cross-sectional view through a conventional form board assembly in which the form boards are an extension of a trench formed in the ground and into which and between the form boards is poured the wet concrete.
Figure 12:
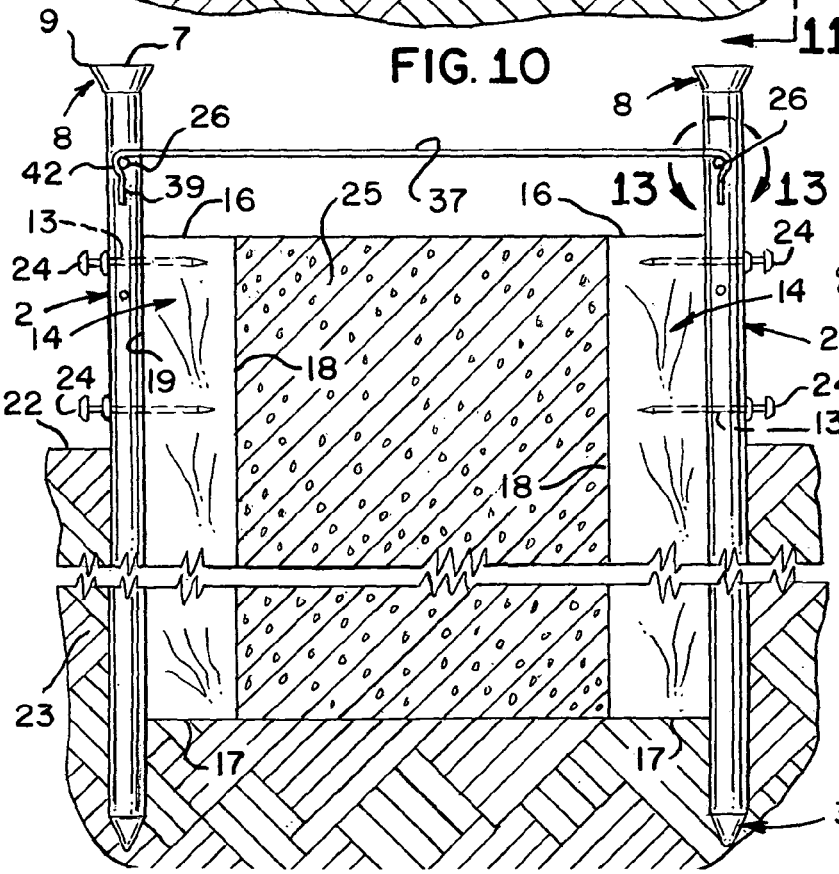
FIG. 12 is a vertical cross-sectional view through a conventional form board assembly in which the form boards are deposited into the bottom of a trench and then retained in position by vertical stakes and a transverse extending retention plate or bar in the manner illustrated in FIG. 9.

Forms for the formation from concrete of stem foundations having some specific height above the ground are frequently formed from elongated wooden planks 14 each having a top edge 16, a bottom edge 17, an inside face 18 and an outside face 19. These wooden planks may be individual planks, as illustrated in the drawings, or they may be multiple planks stacked edge-to-edge one upon another. In either case, the planks must be supported by some means on their outside surfaces 19 to prevent the planks from spreading apart when concrete is poured in the space 21 (FIG. 7) between the planks. In some instances, as illustrated in FIG. 10, the bottom edges 17 of the planks are supported on the surface 22 of the ground designated generally by the numeral 23, while in other instances, as illustrated in FIG. 12, the form members 14 extend below the surface of the ground and to at least some extent the ground helps to prevent the bottom edge portions of the form members from spreading apart. However, in either case, it is necessary to drive the stakes 2 into the ground so that the outer periphery of each stake abuts the outside surface 19 of the form members, and to a sufficient depth that the lower end portion of the stakes provide added resistance to separation of the form members when concrete is poured between them.

Figure 11:
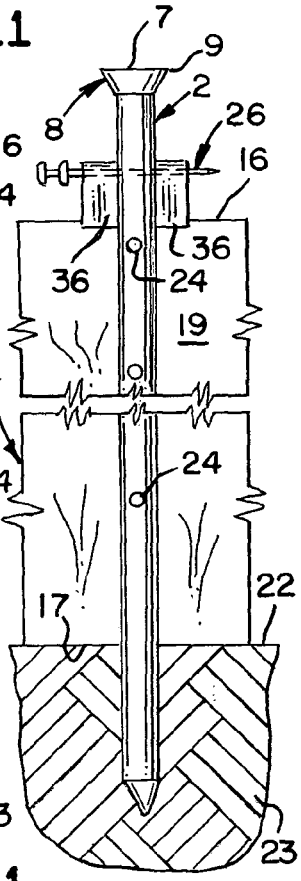
FIG. 11 is a side elevational view of the structure illustrated in FIG. 10.

Referring to FIGS. 10, 11 and 12, when this relationship between the outer periphery of each of the stakes and the outer surface 19 of the form members (boards or planks) is achieved, nails 24, preferably the double-headed type as illustrated, are driven through the bores 13 and into the associated form members 14 to retain the form members detachably secured to the associated stakes. With the stakes detachably secured to the form members in this manner, the longitudinal axis of each of the transversely extending bores 12 extends perpendicular to the longitudinal axis of each of the bores 13 and are spaced intermediate therebetween with the longitudinal axis of each of the bores 12 extending parallel to the outside surface 19 of the associated form member. This special relationship of the bores 12 and 13 to the outside surface 19 of the form members enables the detachable insertion of a retention nail 26 through a selected one of the bores 12 the axis of which lies parallel to the outside surface 19 of the associated form member and above the top edge 16 of the form member as illustrated in FIGS. 7, 10, 11 and 12. This results in the retention nail 26 extending parallel to the top edge 16 of the form member and spaced from the outer surface 19 of the form member a distance of approximately one-half the diameter of the stake less one-half the diameter of the retention nail. Additionally, as illustrated in FIGS. 8 and 9, the length of the retention nail 26 is selected so that when it is inserted through the bore 12, end portions 27 and 28 of the retention nail 26 project approximately the same distance on opposite sides of the stake. A convenient diameter for the stake is ¾" with the bores 12 and 13 being approximately ⅛" to 3/16" in diameter and the retention nail 26 being about 3" in length so that opposite end portions 27 and 28 of the retention nail 26 project approximately one inch from the stake on opposite sides thereof for a purpose which will hereinafter be explained.

The purpose of having the bores 12 extend parallel to the outside surface 19 of the form members when the stakes are driven into the ground is to enable snug but slidable placement of the retention nail 26 in a selected bore 12 so that it too is parallel to the outside surface 19 of the form members and spaced above the top edges 16 thereof as illustrated so that an elongated retention plate or retention bar designated generally by the numeral 31 may be placed to extend transversely above and across the upper edges 16 of the form members and have its opposite ends detachably secured to the associated retention nails 26 that extend through the associated and opposed pair of stakes 2 driven into the ground so that they impinge on the outside surfaces 19 of the opposed form members 14. With the retention plate or bar 31 thus detachably engaged to the retention nails 26 slidably disposed in bores 12 in opposed stakes 2 as illustrated in FIGS. 7–12, and with nails driven through the bores 13 and into the associated surface and body of the form member impinging on a stake, it will be understood that the form members are retained spaced apart a designated distance when wet concrete is poured into the space between the form members and exerts an outward force on the form members because the retention plates or bars 31 are strong enough to withstand the outward exerted force imposed by the wet concrete on the inner surfaces 18 of the form members.

Referring to FIGS. 4, 5, 6 and 7, it will be seen that the retention plate or bar designated generally by the numeral 31 comprises an elongated member having a length that corresponds cooperatively with the selected spacing of the form members, which themselves are spaced apart a distance that corresponds to the thickness of the stem foundation as specified in the building plans pertaining to a particular job. It should be understood therefore that these retention plates or bars 31 might be of different lengths for different jobs or might be of different lengths on different portions of the same job where it is necessary to provide a variance in the thickness of the stem foundation. The retention plate or bar 31 illustrated in FIGS. 4–8 is fabricated from metal, preferably sheet steel, and includes a body 32 having a width of approximately 2" and a length of approximately 13". These dimensions are of course convenient for a particular job and are not to be considered imperative for all retention bars 31, which can of course be of various lengths. At each opposite end of the elongated retention plate or bar, the sheet steel end portions are provided with a semi-circular recess or aperture 33 having a diameter of approximately ¾" which forms the inner end of a slot 34 formed in each of the end portions to provide two bifurcated or laterally spaced anchor members 36, both of which are bent perpendicularly to the main body of the retention plate or bar along the diameter of the aperture 33 to provide a pair of laterally spaced anchor members 36 that extend perpendicular to the plane of the main body portion 32.

Figure 8:
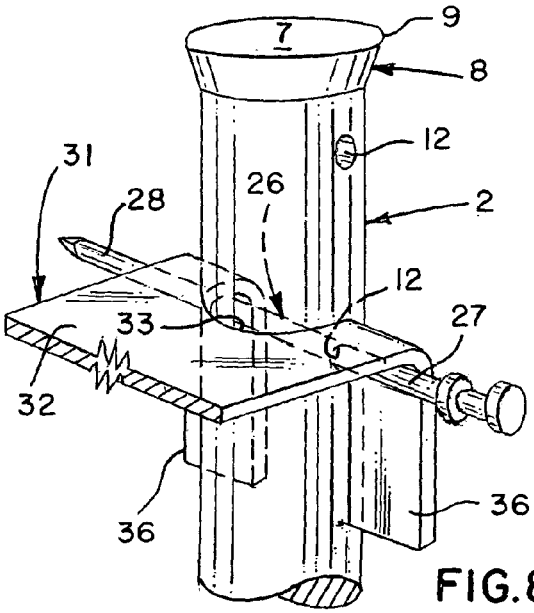
FIG. 8 is a fragmentary perspective view illustrating the detachable attachment of the retention plate of FIG. 4 to an associated stake by means of a nail extending through a bore.
Figure 9:
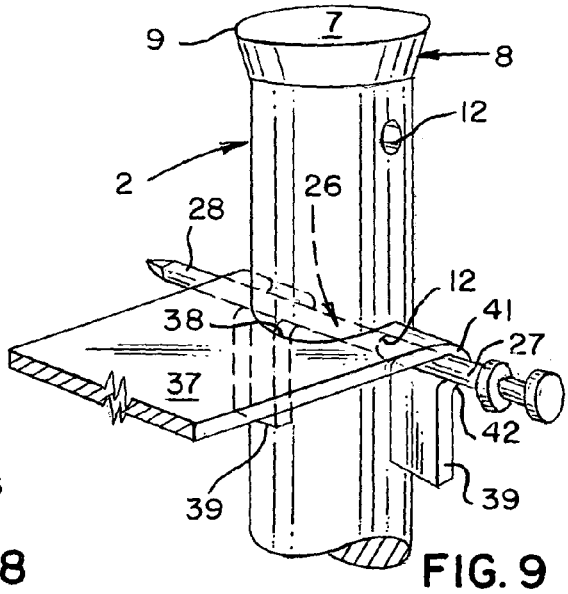
FIG. 9 is a fragmentary perspective view illustrating a second embodiment of the retention plate and the manner of detachable yet secure attachment of the retention plate to an associated stake.

This construction is illustrated in FIGS. 4, 5 and 6 apart from other structure, is shown applied to stakes 2 and form members in FIGS. 7, 10 and 11, and is shown in FIG. 8 applied to a stake 2 by engagement of the anchor members 36 with the retention nail 26 but apart from other structure in the interest of clarity. It will thus be seen from FIG. 8 that when the anchor members 36 engage the retention nail 26, the periphery of the semi-circular recess or aperture 33 abuts or lies closely adjacent to the outer periphery of the stake 2, thus detachably engaging the end of the retention bar and the stake through the inter-engagement of the retention nail 26 with the stake 2 by penetration by the retention nail of the bore 12 and inter-engagement with the retention plate or bar by detachable engagement of the anchor members 36 with the end portions 27 and 28 of the retention nail 26. It will of course be understood that all that is required to effect disengagement of the assembly after the concrete between the form members hardens, is to pull the retention nail from the bore 12, whereupon the retention plate is released from the stake 2. Thereafter, assuming the concrete has hardened sufficiently, the double-headed nails that extend through the bores 13 may be pulled out so as to separate the form members from the stakes, whereupon the stakes and form members may be removed from the stem foundation, cleaned of concrete debri and used on another job.

Figure 13:
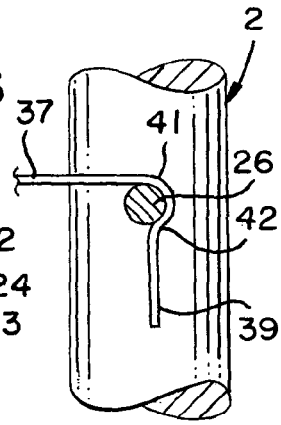
FIG. 13 is a fragmentary elevational view partly in vertical section taken in the plane indicated by the line 13—13 in FIG. 12.

A second embodiment of the retention plate or bar 31 is illustrated in FIGS. 9, 12 and 13, where the retention plate or bar is designated in these views generally by the numeral 37 and is provided with a semi-circular recess or aperture 38 as before and with perpendicularly extending spaced anchor members 39 that define a slot and that are integral with the retention plate 37 and preferably fabricated from sheet steel. The primary difference in this structure from that illustrated in FIGS. 4–6 is that the anchor members 39 are formed at their integral union 41 with the retention plate with reentrant portions 42 that curve partially about the periphery of the retention nail anchor portions 27 and 28 so as to provide a resilient interlocking relationship between the anchor members 39 and the retention nail end portions 27 and 28. The advantage of this construction is that the retention plate or bar 37 of this embodiment is less likely to be inadvertently disengaged from its detachable engagement with the retention nail end portions 27 and 28 whereas in the previously described embodiment of FIGS. 4–8 in which the reentrant feature is omitted, the only force retaining the retention plate or bar against inadvertent disengagement is the frictional resistance that exists between the anchor members 36 and the associated retention nail 26.

Referring to FIGS. 6(A) and 6(B), there is there illustrated a third embodiment of the retention plate or bar 31 illustrated in FIGS. 4–6 and FIGS. 9, 12 and 13. It is reasoned that some jobs will require that the retention plate or bar be of some unusual or indefinite length to properly detachably engage the retention nail 26 slidably disposed in the bore 12 of the stakes 2. It is therefore an advantage that the retention plate or bar designated generally by the numeral 43 illustrated in FIGS. 6(A) and 6(B) possess the capability of being shortened or lengthened to meet the needs of a specific job.

To that end, the retention plate or bar 43 is fabricated as an assembly that includes a two-part body formed by mutually reaching or extending plate members 44 and 46 having overlapping proximate end portions 47 and 48, respectively. As seen in FIG. (6A) the overlapped proximate end portions are provided with transverse apertures 49 and 51, respectively, which may be aligned to adjust the length of the overall assembly and the retained in adjusted position by the placement of a threaded bolt 52 through the aligned holes. A nut 53 threaded onto the threaded bolt following its placement retains the assembly in its adjusted length. The distal end portions 54 and 56, respectively, of the overlapped end portions 47 and 48, are formed with the identical type of recesses or apertures (38) illustrated in FIG. 9 described above. In like manner, the same type of reentrant portion (42) and downwardly extending anchor members 39 illustrated and described in connection with FIG. 9 are provided in the two-part retention plate or bar 43 illustrated in FIG. 6(A). In the interest of brevity in this description the same reference numbers that have been applied to the identical structure of FIG. 9 are applied to the distal end portions of the retention plate or bar 43 illustrated in FIG. 6(A).

Wet concrete that is poured into the space between the form members exerts considerable force against the form members, tending to separate them and this force must be opposed by the transversely extending retention plate or bar detachably secured at opposite ends to the retention nails projecting through the stakes. To resist the transverse force imposed by the wet concrete, the opposing and contiguous surfaces of the overlapped portions of the two-part retention plate or bar may be provided with transversely extending opposed interlocking grooves or channels 57 and lands or ribs 58 formed into the opposing surfaces of the overlapped proximate end portions 47 and 48 of the retention plate or bar 43 illustrated in FIG. 6(A) as seen in FIG. 6(B). A ingle threaded bolt inserted into aligned holes formed in the overlapped portions and secured by a threaded nut will adequately retain the retention plate or bar from elongating as a result of the force exerted by wet concrete. Referring to FIG. 6(B) while holes 49 have been illustrated and described, it should be understood that in the embodiment of FIG. 6(B) longitudinal corresponding slots (not shown) could be formed in the end portions 46 and 47 through which the bolt 52 could be inserted and the nut 53 applied so as to inter-engage the grooves 57 and ribs 58 to retain the retention bar at the selected length. Under these conditions, it should be understood that the grooves and ribs would inter-engage and resist the force applied by the wet concrete with no shear force applied to the bolt.

Having thus described the invention, what is believed to be new and novel and sought to be protected by letters patent of the United States is as defined in the claims that follow.

I claim:

1. A retention apparatus for stabilizing laterally spaced first and second form members defining a cavity for receiving concrete therein and arranged on a supporting surface such as the ground to define said cavity prior to and during the pouring of the concrete and for supporting the wet concrete contained in said cavity for an indeterminate interval following the pouring of the wet concrete, said form members having inside surfaces defining said cavity and confining said concrete and outside surfaces, said retention apparatus comprising:

a) a first elongated metallic stake having a head at one end and a point at the opposite end and adapted to be embedded over an indeterminate length in said supporting surface with an intermediate portion of said elongated stake abutting the outside surface of a first associated form member;

b) a second elongated metallic stake having a head at one end and a point at the opposite end and adapted to be embedded over an indeterminate length in said supporting surface on the opposite side of said cavity from said first elongated metallic stake, said second elongated metallic stake having an intermediate portion abutting the outside surface of said second form member;

c) a first set of a multiplicity of through-bores in each of said first and second elongated stakes, said through-bores of said first set in each elongated stake being spaced along said elongated stake and extending through said stake perpendicular to the outside surface of the associated form board abutted by the intermediate portion of each elongated stake;

d) a second set of a multiplicity of through-bores in each of said first and second elongated stakes, said through-bores of said second set being spaced along said elongated stake intermediate the through-bores of said first set of multiple through-bores and extending parallel to the outside surface of the associated form member abutted by the intermediate portion of each elongated stake and extending perpendicular to the associated first set of multiple through-bores;

e) a nail for driving through each of a selected number of through-bores of said first set of multiple through-bores in each of said first and second elongated stakes and into the associated abutting form member to detachably attach said form members to the associated abutting stakes;

f) a nail slidably and detachably disposed in a selected one of said second set of a multiplicity of through-bores in each of said first and second elongated stakes so that the nail in each stake lies parallel to the nail in the opposite stake and parallel to the outside surface of the associated form member, each nail in each stake including projecting end portions thereof that extend in opposite directions on opposite sides of said elongated stake in which it is detachably supported; and g) means extending transversely across and above said form members and detachably engaged at opposite ends to said projecting end portions of said nails that extend in opposite directions on opposite sides of said stakes and which nails are slidably and detachably disposed in said elongated stakes on opposite sides of said form members.

2. The retention apparatus according to claim 1, wherein said elongated stakes are transversely parallel to one another and abut the outside surfaces of confronting form members.

3. The retention apparatus according to claim 1, wherein said stakes may range in length from approximately 1½ feet to approximately 4 feet.

4. The retention apparatus according to claim 1, wherein each set of said through-bores in said elongated stakes are spaced approximately two inches apart.

5. The retention apparatus according to claim 1, wherein each set of said through-bores in said elongated stakes may range in diameter from approximately ⅛ inch to approximately 3/16 inch.

6. The retention apparatus according to claim 1, wherein said elongated stakes are approximately ¾ inch in diameter.

7. The retention apparatus according to claim 1, wherein one end of each said elongated stake is formed in a truncated conical configuration to form a head larger in diameter than the stake and the opposite end of the stake is formed in a conical configuration the apex of which forms the pointed end of the elongated stake.

8. The retention apparatus according to claim 1, wherein said nails that extend through said first and second sets of through-bores in said elongated stakes are gauged in diameter to slidably fit snugly in the associated through-bores.

9. The retention apparatus according to claim 1, wherein said means extending transversely across and above said form members and detachably engaged at opposite ends to said projecting end portions of said nails that extend parallel to said form members comprises a generally flat elongated plate ranging in width from approximately 1½ inches to 2 inches and having at each opposite end a pair of perpendicularly extending laterally spaced anchor members adapted to detachably engage the projecting end portions of said nails that extend parallel to said form members.

10. The retention apparatus according to claim 9, wherein each said pair of anchor members is integrally connected to said generally flat elongated plate and are spaced apart at least the diameter of the associated elongated stake.

11. The retention apparatus according to claim 9, wherein each said pair of anchor members is integrally connected to said generally flat elongated plate by integral reentrant portions that wrap partially about said projecting end portions of said nail slidably supported in said associated elongated stake whereby to prevent inadvertent detachment of said flat elongated plate from said associated elongated stake.

12. The retention apparatus according to claim 9, wherein said generally flat elongated plate is formed in two parts with proximate end portions of the two parts overlapping intermediate the opposite distal ends of the elongated plate, aligned bores formed in said proximate end portions spaced apart longitudinally, and a nut and bolt assembly projecting through at least one of said aligned bores to retain the elongated plate at a selected length.

13. The retention apparatus according to claim 12, wherein the confronting surfaces of said proximate end portions are provided with interengaging grooves and ribs to retain the elongated plate at a selected length.

14. As an article of manufacture:

a) a force retention plate for use to prevent spreading of form members containing wet concrete, said force retention plate comprising a generally flat elongated plate having at each opposite end a pair of perpendicularly extending laterally spaced anchor members adapted to be detachably engaged to a stake abutting the associated form members;

b) wherein said anchor members are integrally connected to said generally flat elongated plate;

c) wherein each said pair of anchor members is integrally connected to said generally flat elongated plate by integral reentrant portions that provide arcuate recesses detachably engageable to stabilize the position of said generally flat elongated plate; and d) wherein said generally flat elongated plate is formed in two parts with proximate end portions of the two parts overlapping intermediate the opposite distal ends of the elongated plate, aligned bores formed in said proximate end portions spaced apart longitudinally, and a nut and bolt assembly projecting through at least one of said aligned bores to retain the proximate end portions of the elongated plate clamped together.

15. The article of manufacture according to claim 14, wherein the confronting surfaces of said proximate end portions are provided with interengaging grooves and ribs to retain the elongated plate at a selected length when clamped by said nut and bolt assembly.

* * * * *